US006210198B1

(12) United States Patent
McHugh et al.

(10) Patent No.: US 6,210,198 B1
(45) Date of Patent: Apr. 3, 2001

(54) ZERO INSERTION FORCE SOCKET

(75) Inventors: Robert G. McHugh, Evergreen, CO (US); Wen-Chun Pei, Taipei; Yao-Chi Huang, Young-Ho, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/449,195

(22) Filed: Nov. 24, 1999

(51) Int. Cl.[7] ..... H01R 13/62
(52) U.S. Cl. ..... 439/342
(58) Field of Search ..... 439/342, 259, 439/262, 264

(56) References Cited

U.S. PATENT DOCUMENTS 4,801,273 * 1/1989 Ikeya et al. ..... 439/264
5,556,293 * 9/1996 Pfaff ..... 439/259
5,697,803 * 12/1997 Kistner et al. ..... 439/259

* cited by examiner

*Primary Examiner*—Gary F. Paumen
(74) *Attorney, Agent, or Firm*—Wei Te Chung

(57) ABSTRACT

A socket comprises a base having a plurality of lower passageways each of which receives a contact which has an upper section extending upward beyond the base. A cover has a plurality of upper passageways each of which is in communication with one of the lower passageways and adjacent to a retention aperture which accommodates the upper section of the contact. The cover is movably engaged with the base so that when the cover is moved with respect to the base, each contact will be bent by the cover.

1 Claim, 8 Drawing Sheets

ZERO INSERTION FORCE SOCKET

BACKGROUND OF THE INVENTION

1. Field of The Invention

The present invention relates to a zero insertion force socket for a CPU package which is fixed on a frame with the pins thereof inserted into the socket with substantially zero insertion force and being capable of in electrical connection with contacts received in the socket when the socket is changed from a loosened state to a tightened state.

2. Related Art

Conventional zero insertion force (ZIF) sockets are usually installed with an actuation mechanism for controlling insertion/withdrawal of a CPU package. This actuation mechanism is normally controlled by a handle which is operated in a horizontal manner thereby positioning the socket between a loosened state and a tightened state as disclosed in the U.S. patent application Ser. No. 09/131,140 which is assigned to the same assignee of the present application. In the loosened state the socket is prepared for insertion of the CPU package or withdrawal thereof with substantially zero insertion force. In the tightened state, the socket firmly secures pins of the CPU package therein preventing withdrawal of the CPU package. This ZIF socket works well if the CPU package is directly positioned thereon. However, if the CPU package is fixed in a frame with the pins thereof extending downward into the socket, the movement of the cover with respect to the base will force the pins of the CPU package to move thus damaging the pins of the CPU package due to the retention of the CPU package in the frame.

It is requisite to provide a new ZIF socket which can eliminate the damaging problem as described.

SUMMARY OF THE INVENTION

The primary purpose of the present invention is to provide a zero insertion force socket which is operative to move contacts therein to be in contact with pins of a CPU package fixed on an external frame without moving the pins of the CPU package.

Another purpose of the present invention is to provide an electrical assembly having a CPU package fixed on a frame, with pins of the CPU package inserted into a socket with substantially zero insertion force and being in contact with contacts movably received in the socket.

In accordance with one aspect of the present invention, a socket comprises a base having a plurality of lower passageways each of which receives a contact which has an upper section extending upward beyond the base. A cover has a plurality of upper passageways each of which is in communication with one of the lower passageways and adjacent to a retention aperture which accommodates the upper section of the contact. The cover is movably engaged with the base so that when the cover is moved with respect to the base, each contact will be bent by the cover.

In accordance with another aspect of the present invention, an electrical assembly comprises an electrical package fixed in a frame with a plurality of pins extending from the electrical package while not blocked by the frame. A socket comprises a cover movably engaged with a base, wherein the cover defines a plurality of upper passageways communicating with corresponding lower passageways defined in the base, and a plurality of contacts each are partially received in the lower passageway and partially engaged with the cover. Each pin of the electrical package is inserted into a communicated pair of the upper passageway and the lower passageway and remains stationary when the upper passageway is moved with respect to the communicated lower passageway.

DETAILED DESCRIPTION OF THE PREFERRED EMBODIMENT

Figure 1:
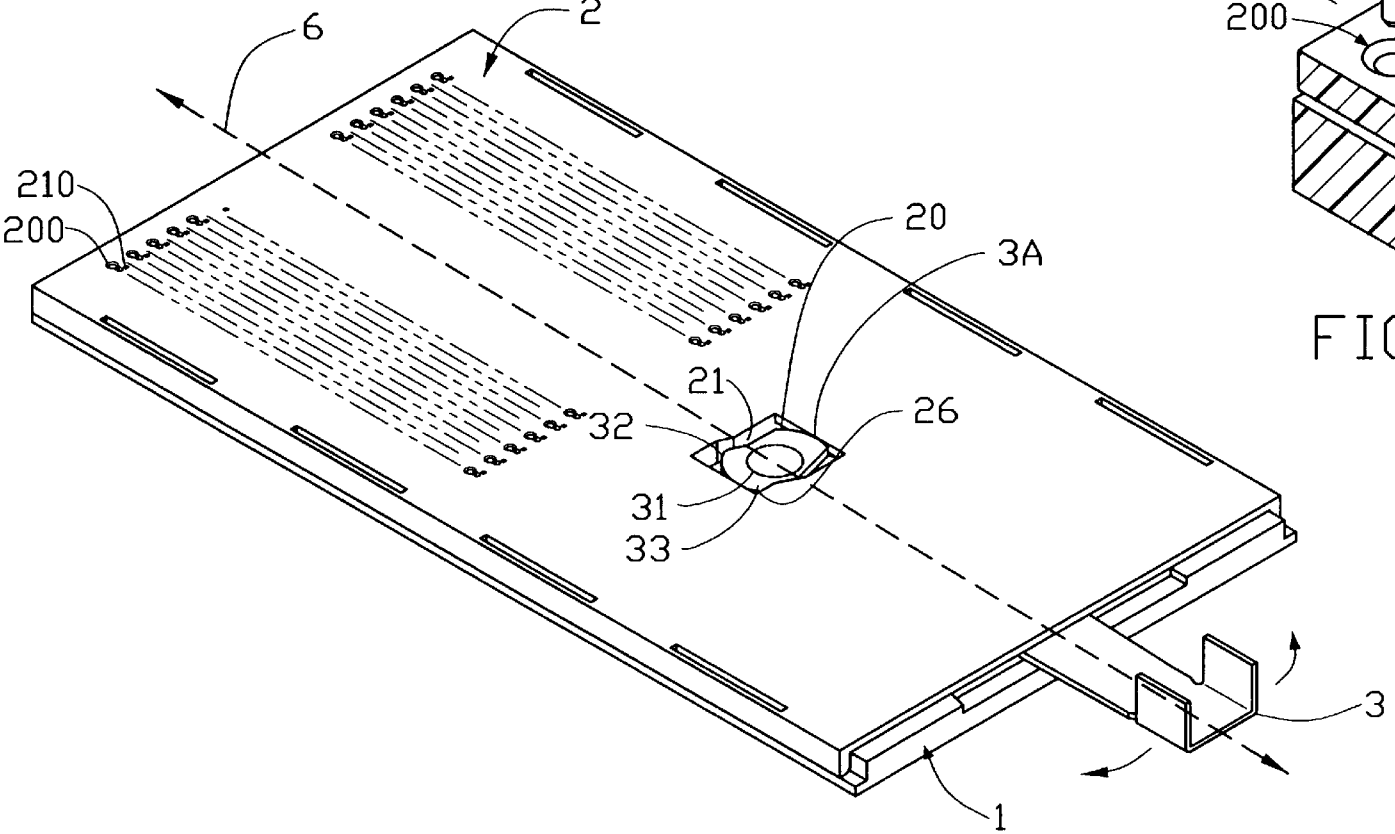
FIG. 1 is a perspective view of a zero insertion force socket in accordance with the present invention.

Referring to FIG. 1, a ZIF socket in accordance with the present invention comprises a rectangular base 1, a rectangular cover movably connected to the base 1, and a cam lever 3 pivotally received between the cover 2 and the base 1 for selectively driving the cover 2 to move along opposite directions of a virtual line 6 parallel to opposite sides of the cover 2. The cover 2 has a hole 20 which is bound by a forward follower side portion 21, a backward follower side portion 26 and two parallel walls (not labeled) between the side portions 21, 26. The cam lever 3 has a cam 3A formed at one end thereof comprising a pivot 31 extending downward for pivotally engaging with the base 1. The cam 3A is confined in the hole 20 of the cover 2 and comprises a forward driving portion 32 operative to move the cover 2 forward on the forward follower side portion 21 thereof, and a backward driving portion 33 operative to move the cover 2 backward on the backward follower side portion 26 thereof.

Figure 2:
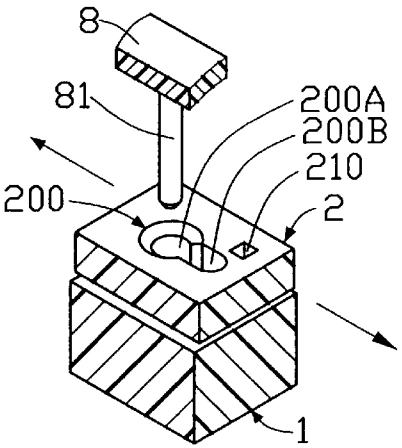
FIG. 2 is an enlarged partial view of FIG. 1 including a portion of a CPU package.

The cover 2 defines a plurality of upper passageways 200 each of which is adjacent to a corresponding retention aperture 210 defined through the cover 2. Referring to FIG. 2, each upper passageway 200 has a main portion 200A and a branch portion 200B communicating with the main portion 200A, wherein the main portion 200A is conical for facilitating insertion of CPU pins 81 extending from a CPU 8. The main portion 200A is circular and has a diameter greater than the width of the branch portion 200B for indicating and guiding a user to insert the CPU pin 81 thereinto.

Figure 4A:
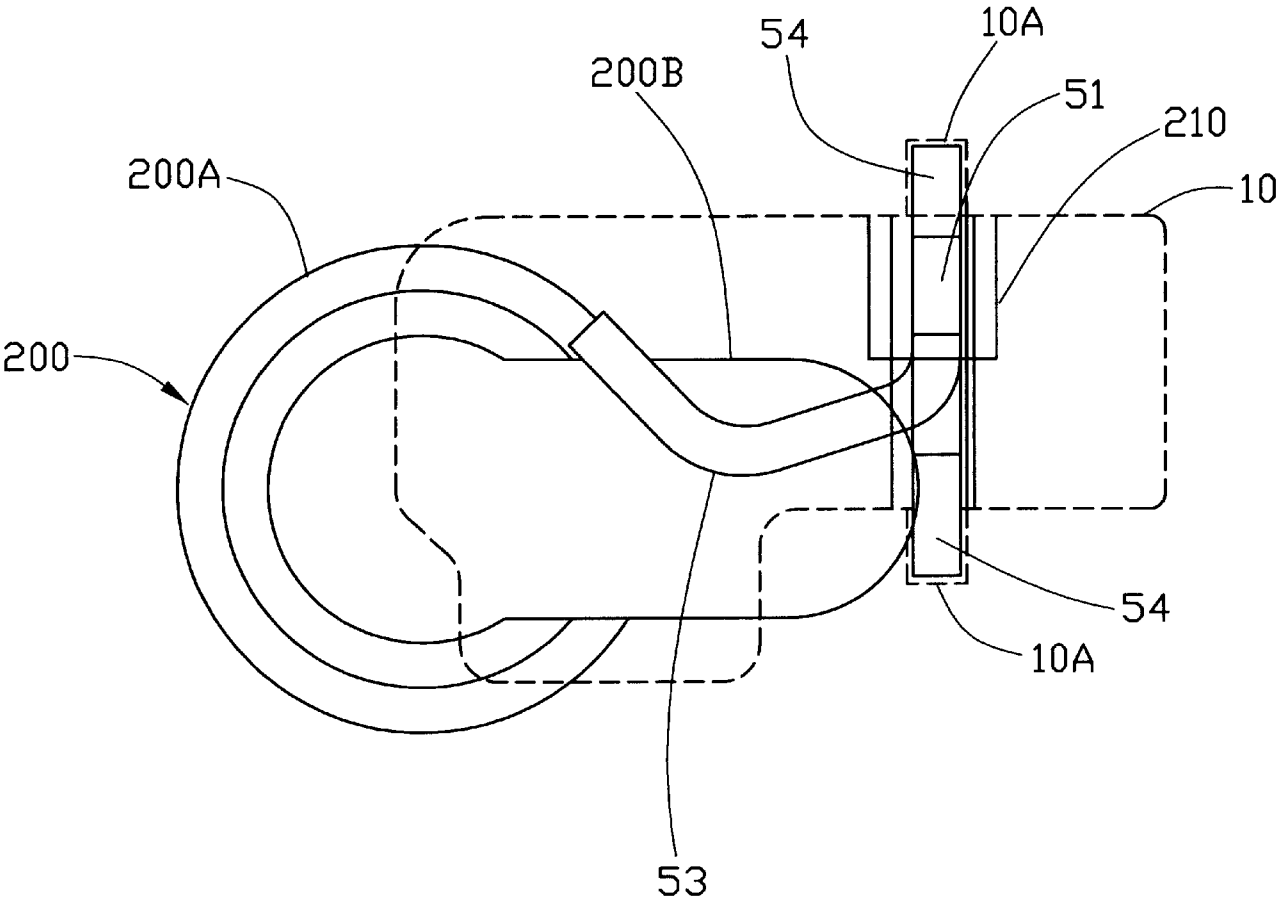
FIG. 4A is a schematic view showing the socket of the present invention is in a neutral state.
Figure 4B:
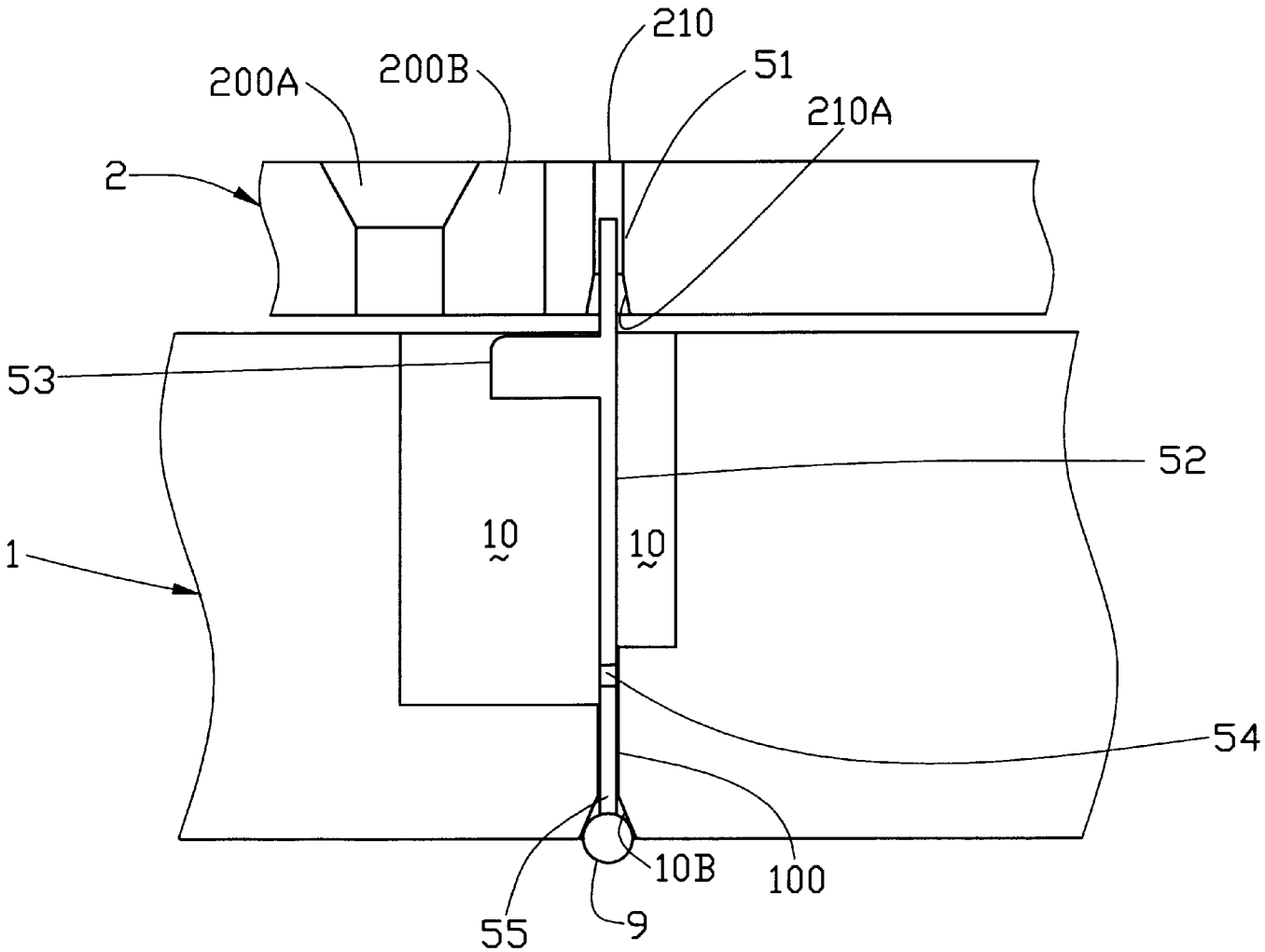
FIG. 4B is a schematic view taken from another direction showing the socket is in the neutral state of FIG. 4A.

Referring to FIG. 4B, the base 1 defines a plurality of lower passageways 10 (only one is shown) each of which has a lower narrow portion 100 extending downward through the base 1. Each lower passageway 10 communicates with a corresponding upper passageway 200 and receives a contact 5 therein, wherein the contact 5 exposes to exterior via the lower narrow portion 100.

Figure 3B:
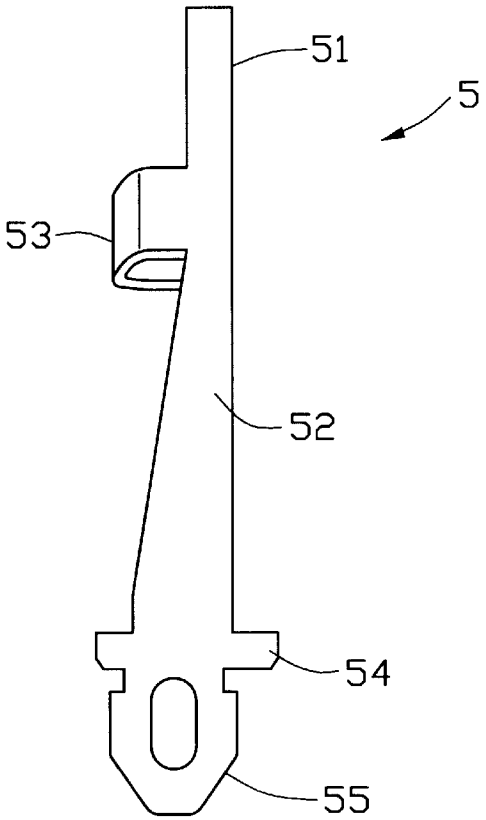
FIG. 3B is a side view of the contact of FIG. 3.
Figure 3A:
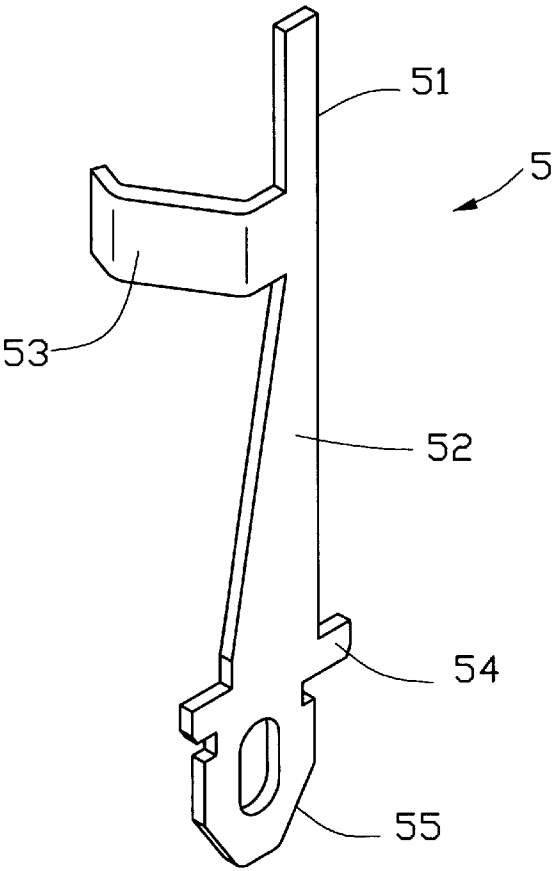
FIG. 3A is a perspective view of a contact used in the present invention.

Referring to FIGS. 3A and 3B, the contact 5 comprises an upper straight section 51 connected to a middle diverged section 52, a contacting section 53 extending from an intersection between the upper section 51 and the diverged section 52. An engagement section 54 extends from two sides of the diverged section 54. A solder tail 55 extends downward from the engagement section 54.

Referring to FIGS. 4A, each lower passageway 10 (shown by phantom line) has opposite side narrow portions 10A for firmly retaining the engagement section 54 of the contact 5. Further referring to FIG. 42, each lower narrow portion 100 of the lower passageway 10 has a diverged portion 10B defined at a lower end thereof. When assembling, the contact 5 is top loaded into the lower passageway 10 and the cover 2 is then assembled to the base 1, with each retention aperture 210 thereof accommodating the upper section 51 of the contact 5. The retention aperture 210 is diverged at a lower portion which is bound by opposite tapered walls 210A. A solder ball 9 is then soldered to the soldering tail 55 of the contact 5 and partially received in the diverged portion 10B partially extending outward beyond the diverged portion 10B. The solder ball 9 is then soldered onto conductive traces of a printed circuit board (not shown) to which the socket is mounted. The lower narrow portion 100 of the lower passageway 10 can effectively prevent wicking problem during soldering procedure due to its narrow width. The socket is in a neutral state as shown in FIGS. 4A and 4B, wherein the contact 5 remains straight and the socket is not ready for receiving CPU pins 81 inserted therein.

Figure 5A:
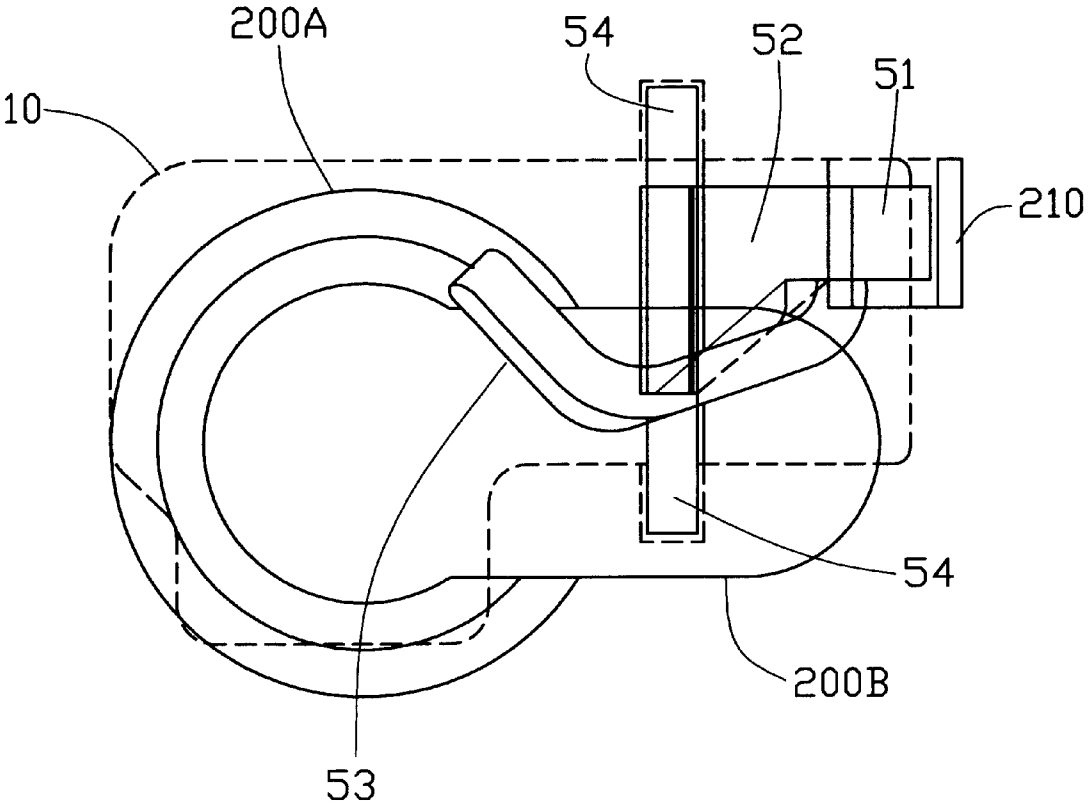
FIG. 5A is a schematic view showing the socket of the present invention is in a loosened state.
Figure 5B:
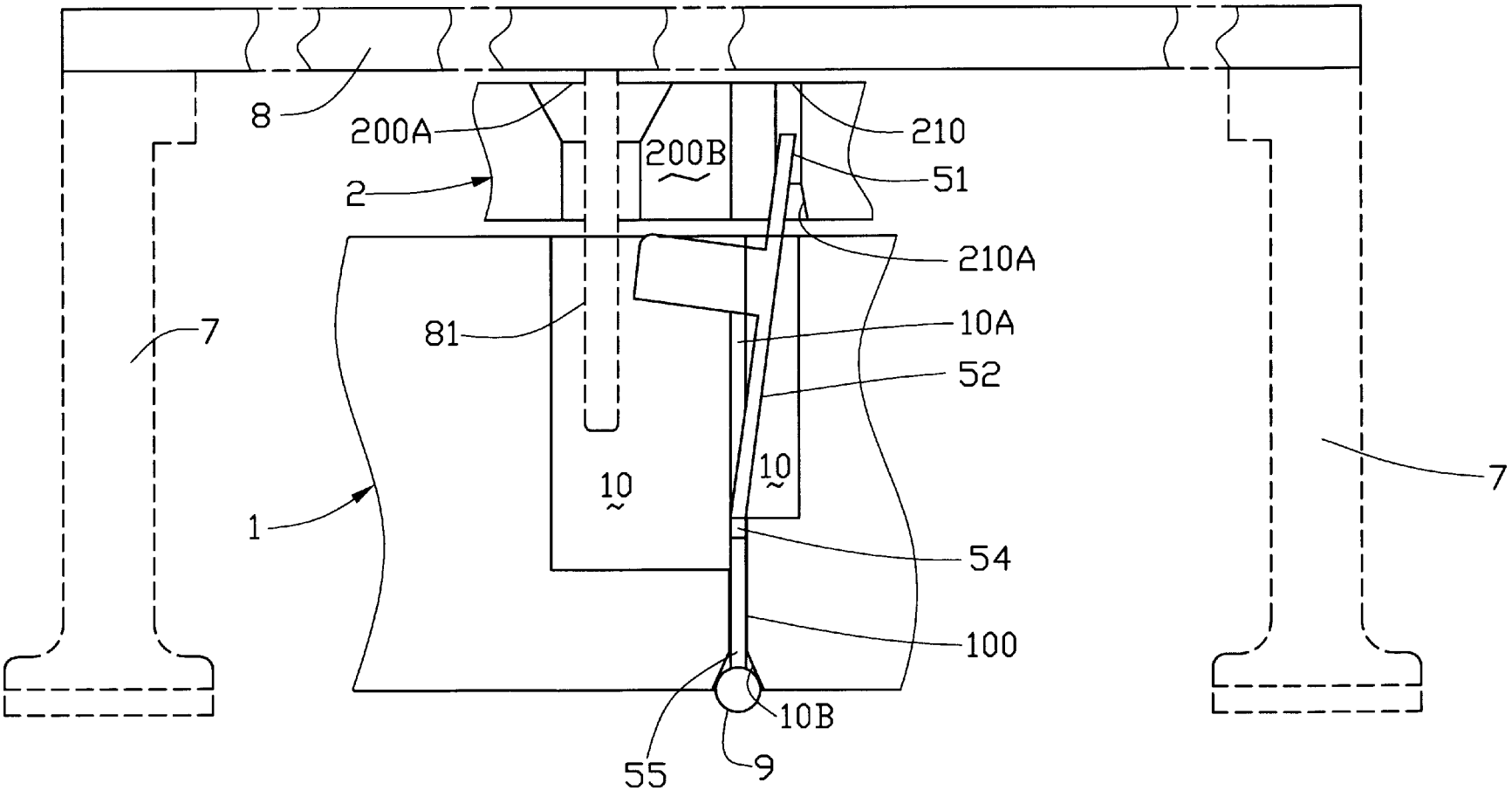
FIG. 5B is a schematic view taken from another direction showing the socket is in the loosened state of FIG. 5A.

Also referring to FIGS. 5A and 5B, the cover 2 is driven by the cam lever 3 to a loosened state in which a vertical space constituted by the main portion 200A of the upper passageway 200 and the lower passageway 10 can receive the CPU pin 81 extending from the CPU 8 with substantially zero insertion force. The CPU 8 is in advance fixed in a frame 7 before the pins 81 thereof being inserted into the socket. The upper section 51 of the contact 5 is bent by the cover 2 especially by one of the tapered walls 210A bounding the engagement aperture 210. The engagement section 54 can absorb most of the tension due to the bending of the upper section 51 thereby preventing the solder ball 9 from being damaged when the socket is changed from the neutral state to the loosened state. Under this situation, the contacting section 53 is in an disengagement position which is away from the engagement position where the contacting section 53 substantially mechanically and electrically connects to the corresponding pin 81.

Figure 6A:
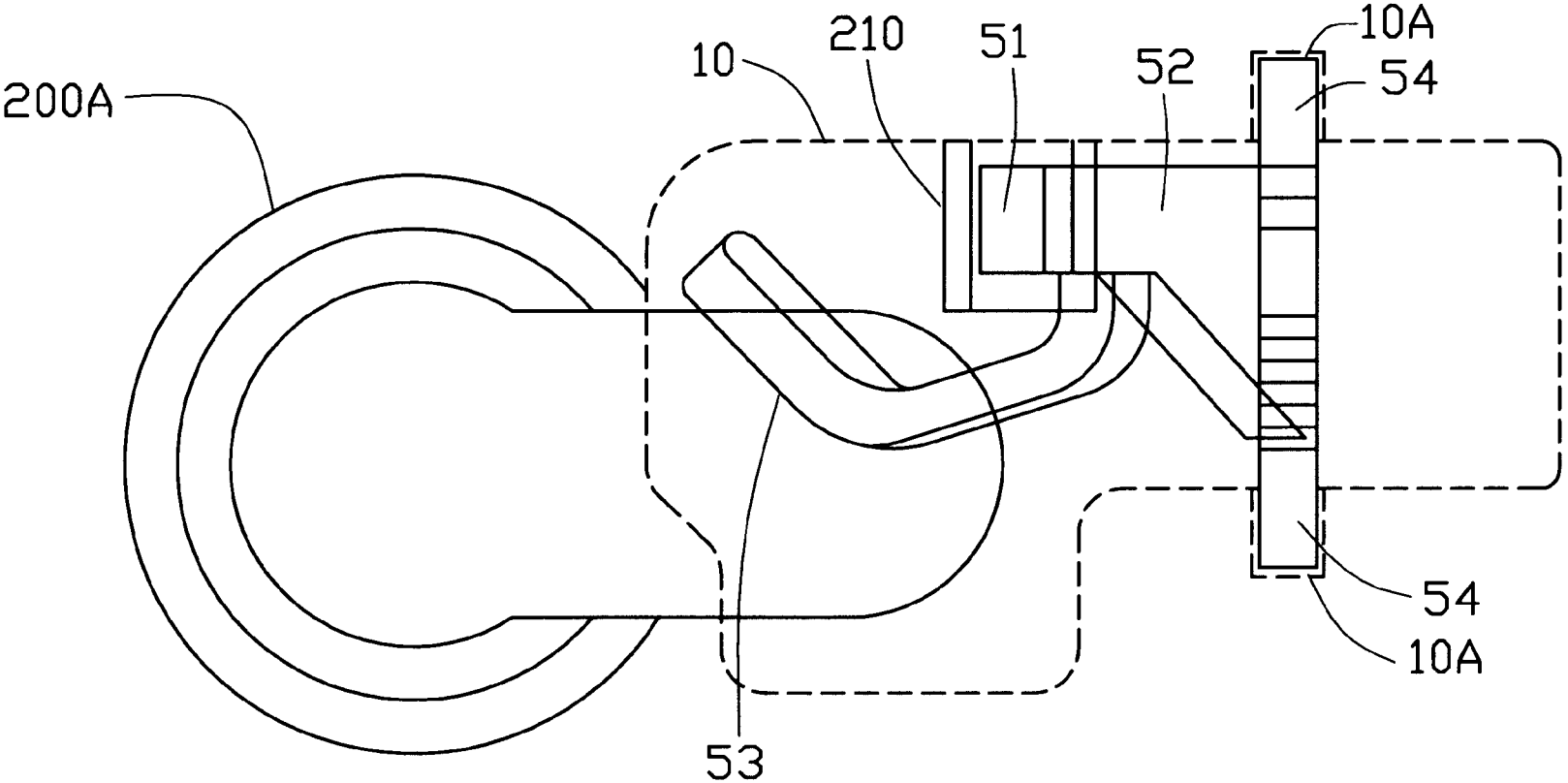
FIG. 6A is a schematic view showing the socket of the present invention is in a tightened state.
Figure 6B:
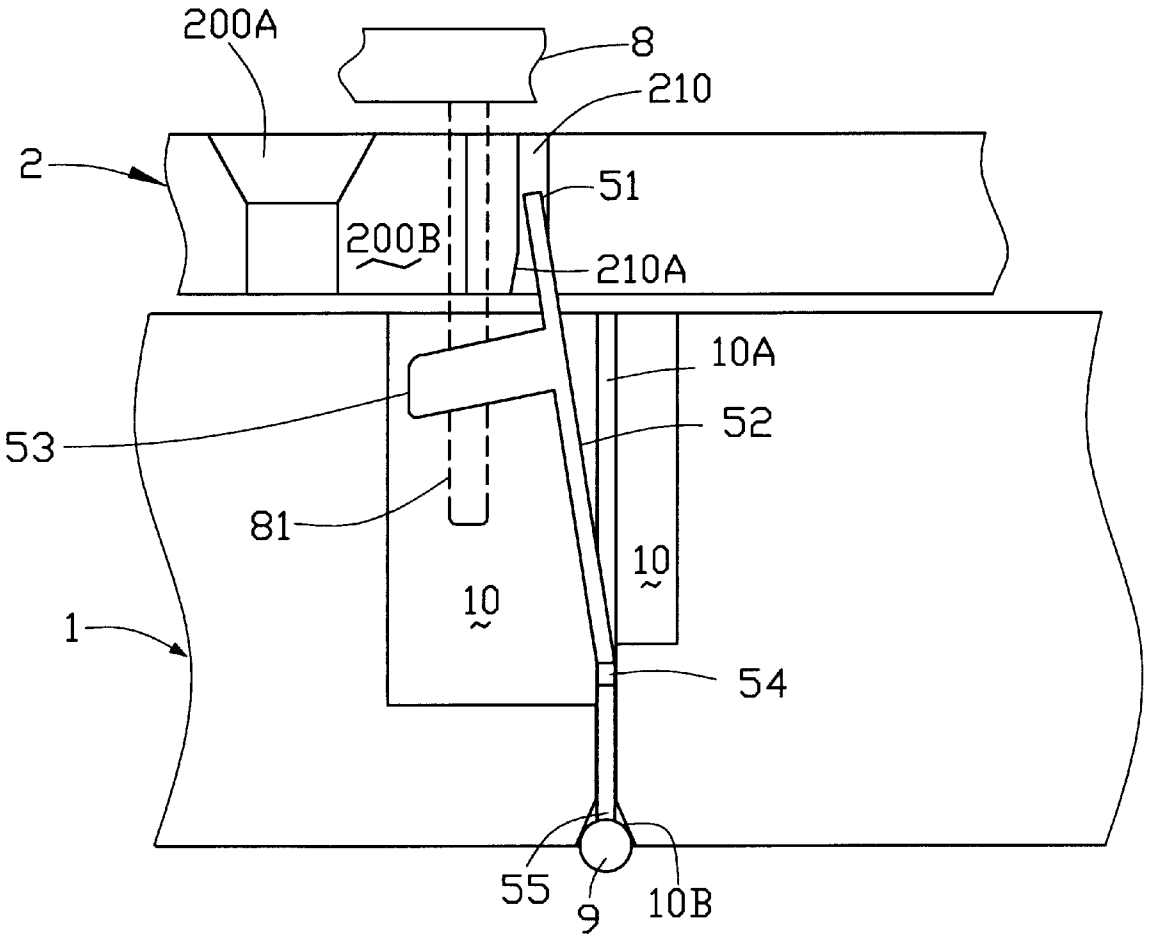
FIG. 6B is a schematic view taken from another direction showing the socket is in the tightened state of FIG. 6A.

After the CPU pins 81 is inserted into the socket, the socket may be operated from the loosened state to a tightened state as shown in FIGS. 6A and 6B. When the socket is changed from the loosened state to the tightened state, the cover 2 is driven by the cam lever 3 thereby bending the contact 5 from the upper section 51 thereof and rendering the contacting section 53 thereof to be in contact with the CPU pin 81. The CPU pin 81 remains stationary when the cover 2 moves from the loosened state to the tightened state. The branch portion 200B of the upper passageway 200 provide a free space allowing the cover 2 to move with respect to the CPU pin 81 without forcing the CPU pin 81 to move accordingly. Specifically, the contact 5 is driven by one of the tapered walls 210A bounding the engagement aperture 210. The base 1 and the CPU 8 remain stationary when the cover 2 is moved from the loosened state to the tightened state.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. An electrical assembly comprising:

a socket including a stationary base and cover moveable with regard to the base in a moving direction;

said base defining a plurality of lower passageways;

a plurality of contacts fixedly received within the corresponding lower passageways, respectively, each of said contacts defining a contacting section on an upper portion thereof and a solder section on the lower portion thereof;

said cover defining a plurality of upper passageways, each of said upper passageways including a main portion and branch portion side by side arranged in said moving direction; and an electrical package including a plurality of pins extending downwardly therefrom; wherein each of said contacts is actuated by the moveable cover to have the corresponding contacting section move relative to the corresponding solder section;

said cover is moved to a first position where the contacting section of each of said contacts is arranged to be located in a disengagement position, and each of said pins extends downwardly into the corresponding lower passageway through the main portion of the corresponding upper passageway; and said cover is then moved to a second position, without moving the electrical package, where the contacting section of each of said contacts is arranged to be in an engagement position and substantially mechanically and electrically connects to the corresponding pin under a condition that each of said pins is changed to be located in the branch portion of the corresponding upper passageway due to relative movement of the cover with regard to the electrical package; wherein the contacting section of each of said contacts is actuated to move in said moving direction by said cover.

* * * * *